United States Patent [19]

Kellogg et al.

[11] 4,010,894

[45] Mar. 8, 1977

[54] CENTRIFUGE FLUID CONTAINER

[75] Inventors: Robert Melroy Kellogg, Endwell; Victor Robert Kruger, Apalachin, both of N.Y.

[73] Assignee: International Business Machines Corporation, Armonk, N.Y.

[22] Filed: Nov. 21, 1975

[21] Appl. No.: 634,209

[52] U.S. Cl. ..... 233/27; 233/26 X

[51] Int. Cl.[2] ..... B04B 5/00

[58] Field of Search ..... 233/1 R, 1 D, 14 R, 233/14 A, 16, 26, 27, 46, 31, 37; 128/2 F; 210/DIG. 23

[56] References Cited

UNITED STATES PATENTS

| | | | |
|---|---|---|---|
| 3,326,458 | 6/1967 | Meryman et al. | 233/26 X |
| 3,708,110 | 1/1973 | Unger et al. | 233/26 |
| 3,724,747 | 4/1973 | Unger et al. | 233/26 X |
| 3,748,101 | 7/1973 | Jones et al. | 233/26 |

*Primary Examiner*—George H. Krizmanich
*Attorney, Agent, or Firm*—Paul M. Brannen

[57] ABSTRACT

A fluid container particularly useful in a centrifuge system for separating the various fractions in blood. The container comprises two circular sheets of flexible material, having central openings therein. The outer peripheral edges are sealed together, as well as annular-like portions extending outwardly from the central opening. Concentric-like inner and outer annular-like channels are thus formed at the outer peripheral portion of the assembly. Radial arcuate portions are sealed off, thereby providing interrupted annular-like channels. At a first end of the inner annular-like channels, an inlet tube is provided, extending outwardly from the central opening and communicating with the first end of the inner annular-like channel. At the outlet or second end of the inner annular-like channel, there is provided a radially extending inter-channel connector, which comprises a sealed off portion extending between the adjacent ends of the inner and outer annular-like channels. Also at this outlet end of the inner channel, a radially enlarged region is provided, acting as a first collecting chamber, into which an outlet tube is sealed, extending from the inner opening. A second collection chamber is provided at the outlet end of the outer annular-like channel. A plurality of outlet tubes extend radially outward from the center of the bag to open within the second collection chamber at different radial distances. Through these outlet tubes, selected separated portions of the fluid are withdrawn from the bag.

10 Claims, 2 Drawing Figures

CENTRIFUGE FLUID CONTAINER

BACKGROUND OF THE INVENTION

Previous centrifuges for separating the components of blood are known in which the centrifuge bowl or chamber is reusable. These devices must be thoroughly cleaned and sterilized after each use, a costly and time-consuming procedure.

DESCRIPTION OF PRIOR ART

Bag-like containers for holding blood or other fluids for processing are known in the art as shown, for example, in U.S. Pat. Nos. 3,064,647 — R. P. Earl; 3,096,283 — G. N. Hein; 3,145,713 — A. Latham, Jr.; 3,239,136 — G. N. Hein; 3,244,362 — G. N. Hein; 3,244,363 — G. N. Hein; 3,297,243 — G. N. Hein; 3,297,244 — G. N. Hein; 3,326,458 — H. T. Meryman et al; 3,456,875 — G. N. Hein; 3,545,671 — E. D. Ross; 3,679,128 — H. P. O. Unger et al; 3,708,110 — H. P. O. Unger et al; 3,724,747 — H. P. O. Unger et al; 3,748,101 — A. L. Jones et al; and 3,858,796 — H. P. O. Unger et al. Also, IBM Technical Disclosure Bulletin, Volume 17, Number 2, July 1974, pages 404 and 405. However, none of this prior art discloses a bag configuration as herein disclosed and claimed, including interrupted annular-like channels as centrifuging channels.

In citing the above prior art, no representation is made nor intended that a search has been made, that better art than that listed is not available, or that other art is not applicable.

SUMMARY OF THE INVENTION

It is a general object of this invention to provide an improved centrifuge container.

A particular object of the invention is to provide an improved fluid container for centrifuging blood to obtain different fractions thereof.

Another object of the invention is to provide an improved fluid container for centrifuging blood, which is simple and economical in construction, disposable after a single use.

The foregoing and other objects, features and advantages of the invention will be apparent from the following more particular description of a preferred embodiment of the invention, as illustrated in the accompanying drawings, and described in connection therewith in the annexed specification.

Briefly described, the improved fluid container provided by this invention comprises two connected interrupted annular-like containers or channels. It is preferably formed by sealing two identical circular pieces of suitable flexible elastic material, such as medical-grade polyvinyl chloride, at the periphery thereof and at selected interior portions, to thereby provide at least two concentric interrupted annular-like channels. The parts are proportioned and arranged so that one end of the inner channel, a first enlarged chamber or volume is provided from which selected blood fractions can be withdrawn via a first outlet tube. The first channel is connected by a passage to the inlet end of the outer channel.

An inlet tube is molded into or sealed into the bag, having its interior end opening into the inlet end of the first or inner channel. A plurality of outlet tubes are provided, opening into the enlarged end of the outer channel, each tube extending radially outwardly to a different distance, so that the various blood fractions which exist at different radial locations as a result of the centrifuging, can be selectively drawn off.

BRIEF DESCRIPTION OF DRAWINGS

In the drawings.

Similar reference characters refer to similar parts in each of the several views.

DETAILED DESCRIPTION OF A PREFERRED EMBODIMENT

Figure 1:
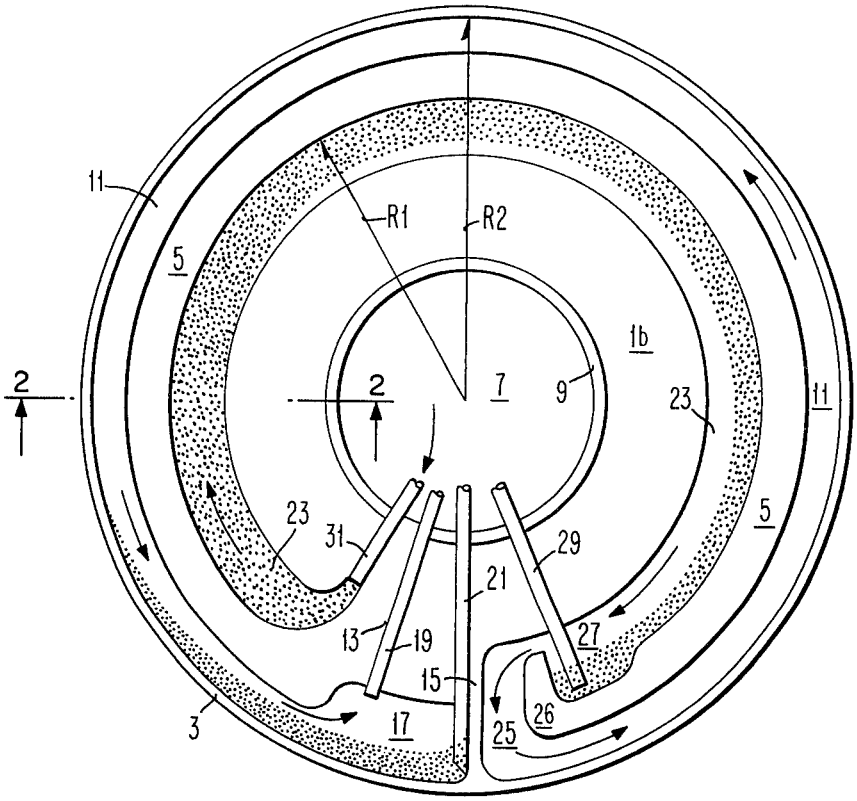
FIG. 1 is a diagrammatic plan view of a centrifuge fluid container comprising a preferred form of the invention.
Figure 2:
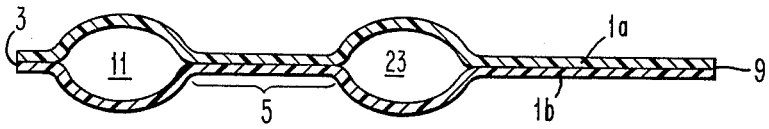
FIG. 2 is a diagrammatic sectional elevation view of the container of FIG. 1, taken at the section 2—2.

Referring to the drawings, the fluid container is circular in shape as can be seen in FIG. 1. Two circular pieces of suitable plastic material 1*a* and 1*b*, forming the top and bottom of bag, are sealed together at their periphery, as by suitable heat and pressure, forming a fluid-tight weld 3 at the outer edge of the bag, as seen in FIG. 2. FIG. 1 illustrates the appearance of the bag with the top piece 1*a* removed. At a first predetermined distance radially inward from the periphery, a second sealed portion 5 is provided, extending almost around the circumference of the bag as shown.

A central opening 7 is provided in the circular pieces, and the juxtaposed edges are welded to form the interior boundary seam 9 as shown.

An outer annular-like channel 11, formed principally by the welds 3 and 5, is not continuous around the periphery of the bag, being interrupted by the radially extending weld 15. One end of the channel 11 is enlarged to form a collection and outlet chamber 17. First and second outlet tubes 19 and 21, respectively, extend into this chamber from the central opening 7. Tube 19 opens into the inward portions of the chamber, and tube 21 opens into the outward portion of the chamber, the tubes having different radial lengths, as can be seen from the drawing.

The other end of the first or outer annular channel 11 is connected to the outlet of the second or inner annular channel 23 by a radial connecting channel 25 formed by the welds or sealed portions of 1*a* and 1*b*. The radially sealed means for forming this connecting channel comprises an inwardly directed hook-shaped sealed portion 26, at one end of the ring-like sealed portion 5, which separates the inner and outer channels, as well as the radial seal means 15. The outlet end of the inner channel 23 is enlarged to form a collection and outlet chamber 27. An outlet tube 29 is provided for this chamber, extending, as shown, from the central opening 7 to the outer portion of chamber 27.

At the other or inlet end of the inner channel 23, there is provided an inlet tube 31, extending radially outward from the central opening 7 to the channel 23, as shown.

In use, the bag is placed in the bowl of a centrifuge which may be constructed in general accordance with the teachings of U.S. Pat. No. 3,748,101. The inlet and outlet tubes are connected to a suitable rotating seal to permit the admission of whole blood and withdrawal of the selected fractions. The centrifuge bowl cover (not shown) is grooved to receive the channels when filled, as shown in the cross-section view of FIG. 2. Whole blood enters the bag through the rotating seal and tube 31. The blood then flows around the innermost channel 23 of the processing bag where it is subjected to a radial G force induced by bowl rotation. At the end of this first separation channel is the small collection volume 27 where the packed red cells are accumulated for removal through the tube 29. The radial distance, channel cross-section area and the angular rotation are selected to provide separation which will produce platelet-rich plasma (PRP) at an efficiency of approximately 60%. The PRP is not removed from the system at this point, however, but is led via channel 25 to the outermost separation channel 11. The PRP flows around this channel and is separated into platelet-poor plasma (PPP) and a platelet concentrate (PC). These fractions are withdrawn through their respective tubes 19 and 21.

Previous experience with batch and continuous flow platelet separation indicates that the separation parameters to produce PC from PRP should be approximately four times those required to produce PRP from whole blood. Using as a measure, G multiplied by the time exposed to the G force, as a measure of the separation ability of a particular channel, it can be shown that $R_1$ should be approximately $0.8R_2$.

From the foregoing, it will be apparent that the present invention provides a novel centrifuge container which is advantageous from the standpoint of being economical to fabricate and because the economy is adapted to single use, wherein the bag with its associated tubing, etc., is used one time and then discarded, thereby relieving the duties of cleaning and sterilization required with reusable centrifuge containers.

While the invention has been particularly shown and described with reference to a preferred embodiment thereof, it will be understood by those skilled in the art that various changes in form and details may be made therein without departing from the spirit and scope of the invention.

We claim:

1. A flexible collapsible centrifuge fluid container comprising two circular pieces of material sealed together at the outer periphery and each having a central opening, the edges of the openings being sealed together, a plurality of sealed-together annular-like portions of said two pieces of material, forming a plurality of separate concentric-like annular channels, and inlet/outlet tubes sealed in said material and communicating with said channels.

2. A container as claimed in claim 1 in which said material is medical-grade polyvinyl chloride.

3. A container as claimed in claim 1 further characterized by at least one radially sealed means for sealing said pieces of material to form said interrupted annular-like channels.

4. A container as claimed in claim 3 in which two radially extending seal means are provided to form a connecting passage between the annular channels.

5. A container as claimed in claim 4, wherein said channels are connected by said seal means to provide a serial flow path through the innermost of said channels, through said connecting passage, and through the outermost of said channels.

6. A flexible collapsible centrifuge fluid container comprising two circular pieces of material sealed together at the outer periphery and each having a central opening, the edges of the openings being sealed together, a plurality of sealed-together annular portions of said two pieces of material, forming an inner concentric annular-like channel and an outer concentric annular-like channel, and inlet/outlet tubes sealed in said material and communicating with said channels.

7. A container as claimed in claim 6 in which said material is medical-grade polyvinyl chloride.

8. A container as claimed in claim 6 further characterized by at least one radially sealed means for sealing said pieces of material to form said interrupted inner and outer annular channels.

9. A container as claimed in claim 8 in which two radially extending seal means are provided to form a connecting passage between the annular channels.

10. A container as claimed in claim 9, wherein said channels are connected by said seal means to provide a serial flow path through the innermost of said channels, through said connecting passage, and through the outermost of said channels.

* * * * *